United States Patent [19]

Mondello et al.

[11] Patent Number: 4,598,572

[45] Date of Patent: Jul. 8, 1986

[54] APPARATUS AND GRIPPING JAW ASSEMBLY FOR SETTING FASTENERS

[75] Inventors: Brian C. Mondello, Tivoli; Hendrik E. Rosier, Kingston, both of N.Y.

[73] Assignee: Huck Manufacturing Company, Irvine, Calif.

[21] Appl. No.: 698,174

[22] Filed: Feb. 4, 1985

[51] Int. Cl.[4] ..... B21D 31/00

[52] U.S. Cl. ..... 72/391; 403/375; 403/109; 411/34

[58] Field of Search ..... 72/391, 453.05, 453.17; 411/361, 337, 34, 41, 43, 70; 403/377, 381, 375, 349, 354, 351, 109; 285/255, 257, 238, 323, 331

[56] References Cited

U.S. PATENT DOCUMENTS 2,855,206 10/1958 Haviland ..... 403/375
3,605,201 8/1971 Peterson ..... 403/375
3,886,782 6/1975 Miyamoto ..... 72/391
4,347,728 8/1982 Smith ..... 72/391

FOREIGN PATENT DOCUMENTS 3244398 6/1984 Fed. Rep. of Germany ..... 403/375

*Primary Examiner*—Lowell A. Larson
*Assistant Examiner*—David B. Jones
*Attorney, Agent, or Firm*—Harness, Dickey & Pierce

[57] ABSTRACT

A tool for setting a fastener which includes a pin having a plurality of grooves adapted to be gripped by a plurality of jaws in a nose assembly of the tool with the jaws being resiliently held in flexible pockets in a manner maintaining the jaws in a desired axial and radial alignment with each other and with the fastener grooves and with the jaws being selectively movable into and out of the pockets whereby manual insertion and replacement is facilitated.

14 Claims, 5 Drawing Figures

APPARATUS AND GRIPPING JAW ASSEMBLY FOR SETTING FASTENERS

SUMMARY BACKGROUND OF THE INVENTION

The present invention relates to tools for setting fasteners having pin members with pull grooves and more particularly to tools having a plurality of jaws for gripping the pull grooves.

In setting multi-pieced fasteners, including a pin and sleeve or collar, of types such as those shown in the U.S. Pat. Nos. 2,527,307 and 2,531,048 issued to L. C. Huck on Oct. 24, 1950 and Nov. 21, 1950, respectively, it has been the practice to utilize a tool having a plurality of independently movable chuck jaws. The latter are generally shown in the above noted patents to L. C. Huck and the details of the same are exemplified in the U.S. Pat. No. 3,107,806 issued Oct. 22, 1963 to G. J. Van Hecke et al. The chuck jaws have teeth adapted to grip pull grooves on the pin.

With such jaw structures it is possible under certain conditions, such as pin insertion, for the jaws to move out of axial alignment with each other. When such misalignment occurs and the tool is actuated, the pull grooves on the pin are gripped by less than the full complement of jaws; this can lead to stripping of the jaw teeth, stripping of the pull grooves and/or ultimate failure of one or more jaws.

In addition such jaw structures are normally held closed in a radially inward position by a spring biased jaw follower assembly. Thus, in order to insert the pin into the jaws the spring bias load must be overcome as the jaws are moved axially rearwardly and radially outwardly. In some assembly operations such insertion loads can be undesirably high.

A solution to this was to provide a structure in which the jaws, which are conventionally constructed to hardened steel, are secured to an elastomeric structure such that the jaws are generally axially fixed relative to each other and axial misalignment is substantially precluded. This is shown in the U.S. Pat. No. 4,347,728 issued on Sept. 7, 1982 to Smith. While that structure resulted in a significant improvement, when one of the jaws eventually failed or became detached from the elastomeric structure, the entire jaw assembly had to be replaced. The present invention is an improvement on that structure and while providing the advantage of that structure also permits replacement and facilitates assembly of individual jaw members. Thus it is an object of the present invention to provide an improved jaw structure of the type shown in the noted Smith patent in which the jaw segments can be readily assembled and replaced.

It is another general object to provide a new and improved jaw structure for tools for setting fasteners of the type having a pin with pull grooves.

Other objects, features, and advantages of the present invention will become apparent from the subsequent description and the appended claims, taken in conjunction with the accompanying drawings, in which:

Figure 1:
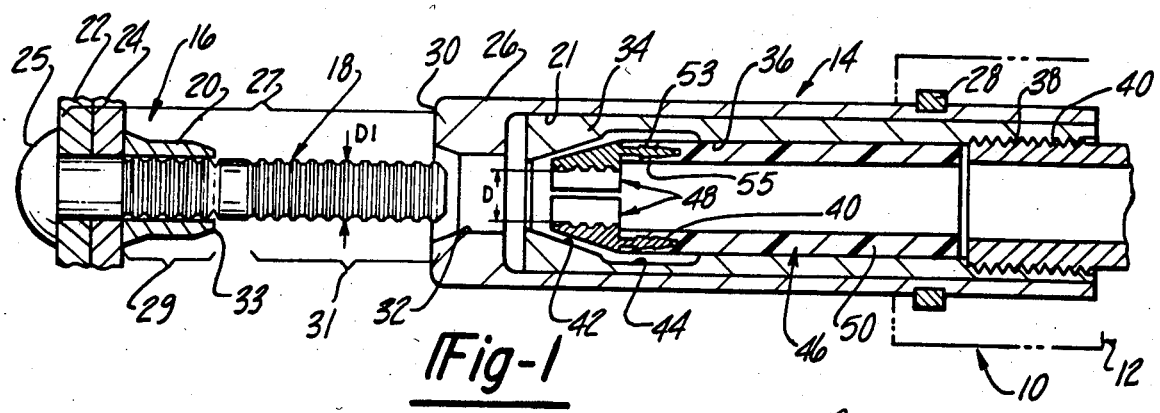
FIG. 1 is a longitudinal view, with some parts shown in section, of a tool of the present invention prior to application of the tool to a fastener to be set.

Looking now to the drawings, a pull gun assembly or tool is generally indicated by the numeral 10 and comprises a pull gun member 12 (partially shown in phantom lines) which is operable with a nose assembly 14 for setting a fastener 16. The fastener 16, includes a pin member 18 and a collar 20, adapted to be swaged thereon, with the pin 18 being disposed in aligned bores in a pair of workpieces 22 and 24. The pull gun member 12 can be of a conventional type capable of applying a relative axial force such as that described in the patent to L. C. Huck, U.S. Pat. No. 2,132,122.

The nose assembly 14 comprises a generally tubular outer anvil member 26 having an axial bore 21 and having radially extending ears or lugs 28 proximate one end for locking engagement with the receiving end of the casing of the gun member 12 by means known to the art. In this regard the ears or lugs 28 could be provided by a separate ring and groove combination.

The opposite end of the outer anvil member 26 is substantially closed by an anvil portion 30 having a swaging bore 32 located therein. Note that in some constructions a separate anvil portion could be utilized. The swaging bore 32 can have a variety of shapes selected to facilitate swaging.

Slidably disposed within the outer anvil member 26 is a generally tubular collet member 34 which has an axial bore 36 which is internally threaded at its rearward portion 38. This rearward portion 38 is threadably engaged with a threaded portion 40 of a piston rod (partially shown) of the pull gun member 12. The forward end of the collet member 34 has an axially outwardly extending radially inwardly tapered bore 42 which terminates at its enlarged end in an increased diameter bore portion 44.

A jaw assembly 46 is slidably disposed within the bore 36 of collet member 34 and comprises a plurality of jaw members 48 secured at their rearward ends to the end of a generally tubular elastomeric support member 50. The outer surfaces of the jaw members 48 define a frusto conically inclined surface which is matable within the tapered collet bore 42.

The elastomeric support member 50 is of a resilient construction which can be a flexible urethane or a synthetic or natural rubber combined (polymerized) with one or more co-monomers or co-polymers; the latter can be thermosetting or vulcanized.

Figure 2:
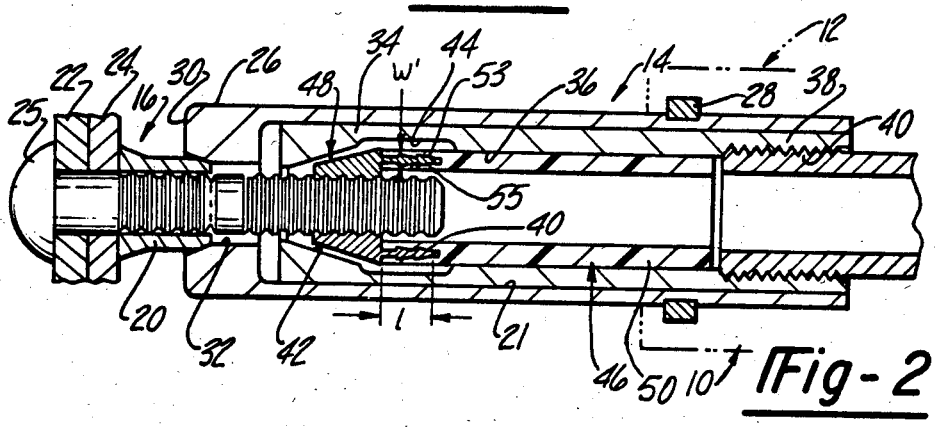
FIG. 2 is a similar longitudinal view showing the tool applied to the fastener but prior to actuation of the tool.
Figure 5:
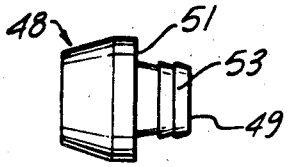
FIG. 5 is an elevational view to enlarged scale of one of the jaw segments of the jaw assembly.
Figure 4:
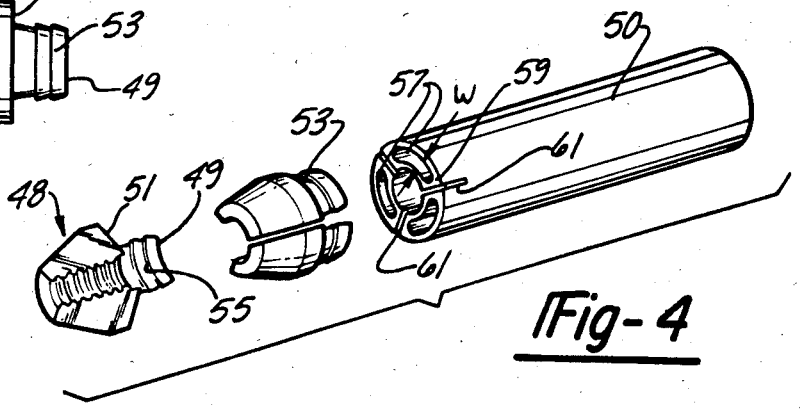
FIG. 4 is an exploded pictorial view of the jaw assembly of the present invention.

The jaw members 48 (which in one form are three in number) are resiliently but removably secured to the sleeve member 50. Thus each of the jaws 48 terminates in a reduced section portion 49 which extends from an enlarged section seating surface 51 (see FIGS. 4 and 5). Reduced portion 49 is provided with radially outwardly and radially inwardly extending ribs 53 and 55, respectively. The mating end of the elastomeric member 50 is provided with a plurality of elastic pockets 57 which can be molded or otherwise formed thereon. Each of the pockets 57 is of a contour generally complementary to the ribbed end portion 49 but are internally smooth and of a width W slightly less than the width W′ between ribs 53 and 55 (FIGS. 2 and 4). Thus when the ribbed end portions 49 are inserted into the pockets 57 the elastomeric material will expand and then generally conform to the ribbed shape of end portion 49. In this manner the ribbed end portions 49 will be gripped by the material defining the pockets 57.

The depth of pockets 57 is slightly greater than the length l of end portions 49. Thus the jaw seating surface 51 will seat against the end surface 59 of tubular member 50. In this way, with end surface 59 being formed square to the axis of member 50, the jaws 48 will be axially located in line with each other. Note that with the relatively thin sections defining the pockets 57 some radial misalignment can be accommodated by axial shifting of the jaws 48 with or relative to the pockets 57.

A plurality of axial slots 61 (FIG. 4) separate each of the pockets 57 and its respective one of the jaws 48. This further enhances the flexibility and alignment capability of the jaws 48. Such slots have been used on non-removable structures such as that shown in Smith, supra.

The fastener 16 can be generally of the type shown in the noted patents to L. C. Huck (supra) and as such the pin 18 has an enlarged head 25 and a shank 27. The shank 27 includes a lock groove portion 29 having annular grooves adapted to receive the collar 20 when it is swaged therein by the tool 10 via the outer anvil 26. The shank 27 terminates in a pull portion 31 including a plurality of annular pull grooves. A breakneck groove 33 defines the weakest portion of the shank 27. The fastener 16 is set by the tool 10 applying a relative axial force between the pin 18 and collar 20 by the jaw members 48 gripping the pull grooves of pull portion 31 and anvil 26 engaging the collar 20. In this regard, each of the jaw members 48 has a plurality of teeth 52 for gripping the pull grooves of the pull portion 31. Note that the teeth 52 are of a shape which are similar to and generally complementary to the grooves of pin member 18. As secured to the support member 50, the teeth 52 of each of the jaw members 48 are located and held in axial alignment with those of the other jaw members 48. Since substantial relative axial movement between jaw members 48 is inhibited by the support member 50, axial misalignment between teeth 52 is inhibited whereby proper engagement of the grooves of the pin 18 by the teeth 52 of all of the jaw members 48 is substantially assured.

It is desirable that, during insertion of the pin 18, the jaw members 48 not be urged to a closed position under a high preload. To this end, with the present invention, the jaw members 48 are located and held via the generally flexible connection with the pockets 57 of support member 50 and separating slots 61, such that in their relaxed, non actuated condition the jaw members 48 are generally opened, i.e. radially spaced from each other; in this opened condition the crests of the jaw teeth 52 define an insertion diameter D which is less than the crest diameter D1 on the pin member 18 whereby a preselected minimum interference is provided. The flexible connection of jaw members 48 to the support member 50 provides a minimum insertion force when the pull gun 10 is applied to the pin 18 and at the same time there is sufficient interference (i.e. between D and D1) to provide sufficient initial gripping. The initial gripping of the pin member 18 occurs when the pull gun assembly 10 is actuated to move the collet member 34 rearwardly relatively to the outer anvil 26 at which time the tapered bore 42 engages the frusto conical surface of the jaw members 48. The initial gripping or interference must be sufficient to hold the jaw assembly 46 to the grooves of the pin 18 so that the jaws 48 will not slip off the pull grooves of the pin 18. Further relative rearward movement of the collet member 34 will cause the jaw members 48 to be located forwardly (relatively) into the tapered bore 42 causing the jaw members 48 to attain their fully closed position whereby gripping of the pin 18 is complete. Further movement of the collet 34 and the jaw assembly 46 relative to the outer anvil 26 will result in application of the desired relative axial force between pin 18 and collar 20 and in setting of the fastener 16; if the stroke of the pull gun 12 is insufficient to completely set the fastener 16, its continued actuation will result in a second cycle, i.e. reciprocation of collet 34 and jaw and follower assembly 46 whereby the pin member 18 will be gripped closer to the collar 20. Upon setting of the fastener 16 the pin member 18 will be severed at the breakneck groove 33 near the end of the collar 20. The severed portion of the pin member 18 will pass through the pull gun 10 via support member 50 for ejection out the rear of the pull gun 10.

Figure 3:
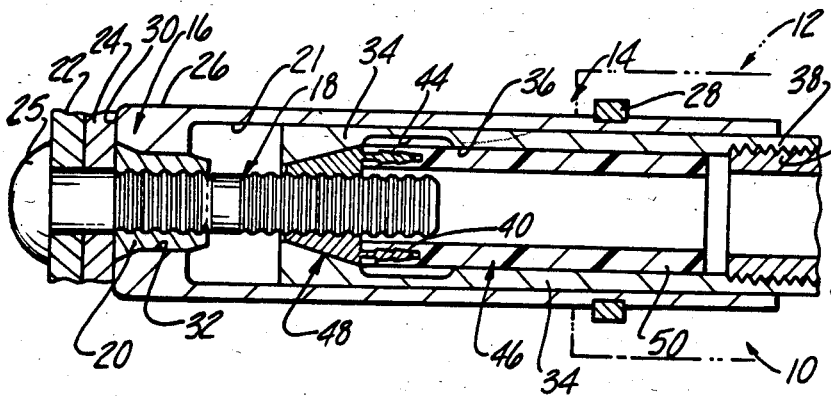
FIG. 3 is a similar longitudinal view showing the tool and fastener with the tool having been actuated and in its pull stroke and with fastener having been substantially set.

Note that in the present construction of FIGS. 1–3, the jaw assembly 46 is free to float, i.e. move axially, within the collet 34 between the threaded portion 40 of the piston rod and the tapered bore 42. This permits some degree of radially outward movement of the jaw members 48 whereby the pin member 18 can be inserted through the opening (diameter D) with a ratcheting type action. It is preferred, however, that the amount of axial movement of the jaw and follower assembly 46 be limited to no more than around one pitch, P, of the pull grooves of pin member 18. This limitation on the axial float is provided to minimize any reduction in grip capability of the nose assembly 14, i.e. the minimum length of pin member 18 required to permit gripping by the jaw members 48. The axial float can be minimized or eliminated where the flexibility of the support member 50 at the rear for example is sufficient to permit the necessary movement of the jaw members 48 as a unit.

The pockets 57 of support member 50 being resilient not only permit deflection of the jaw members 48 and also provide a shock absorbing function at pin break. Since the support member 50 extends generally for the length of the collet bore 36 that portion of the pin member 18 severed at pin break and resultant debris carried by the broken pin portion or otherwise located within the support member 50 can be expelled thereby reducing the likelihood of jamming the nose assembly 14.

Note that each of the jaws 48 is resiliently gripped within pockets 57. However, each jaw 48 can be readily manually removed and replaced. Thus with the construction shown, in the event that one of the jaws 48 is damaged the damaged jaw can be replaced without the need to replace the entire assembly comprised of the tubular member 50 and jaws 48.

At the same time assembly of the jaws 48 to the support member 50 is facilitated since they can be quickly inserted into the pockets 57.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed:

1. Apparatus for applying a fastener to workpieces which fastener includes a pin member having a shank and a plurality of grooves therein and a tubular fastener member adapted to be located over the shank of the pin member with the fastener being secured to the workpieces in response to a relative axial force applied to the fastener, said apparatus comprising a generally tubular anvil member having a forward portion thereof for engaging the tubular fastener member, a generally tubular collet member slidably located within said anvil member and having an axial bore terminating at its forward end in a tapered bore portion, a jaw assembly comprising a plurality of chuck jaws and a support member, said chuck jaws being of a rigid construction and defining a frusto conical outer surface adapted to generally matably fit within said tapered bore portion of said collet and each having an inner surface with a plurality of jaw teeth thereon adapted to grip the grooves of the pin member, said support member disposed in said axial bore and including elastomeric means constructed of an elastomeric material for resiliently securing said chuck jaws to a forward end of said support member for resilient, radial movement between open and closed positions, each of said jaws having a reduced section end portion, said elastomeric means comprising a plurality of elastic pockets integrally formed at said forward end of said support member and adapted to grippingly receive said reduced section end portion, said elastic pockets having a depth at least equal to the length of said jaw end portions, each of said jaws having a seating surface from which said end portion extends, said seating surface adapted to engage said forward end of said support member to locate said jaws in axial alignment with each other whereby said teeth on said jaws are maintained in line with each other, said elastic pockets being defined by relatively thin sections whereby misalignment of said jaw teeth can be accommodated by axial shifting of said chuck jaws, said elastomeric means including said elastic pockets resiliently gripping said jaws for selective movement into and out of said pockets whereby manual insertion and replacement is facilitated.

2. The apparatus of claim 1 with said elastic pockets having a generally smooth internal surface and with said jaw end portion being of a ribbed structure defining an interference fit with said pocket internal surface for facilitating resilient gripping by said elastic pockets.

3. The apparatus of claim 1 with said elastic pockets being circumferentially separated from each other by axially extending slots.

4. Apparatus for applying a fastener to workpieces which fastener includes a pin member having a shank and a plurality of grooves therein and a tubular fastener member adapted to be located over the shank of the pin member with the fastener being secured to the workpieces in response to a relative axial force applied to the fastener, said apparatus comprising a generally tubularly shaped anvil member having a forward portion thereof for engaging the tubular fastener member, a generally tubular collet member slidably located within said anvil member and having an axial bore terminating at its forward end in a tapered bore portion, a jaw assembly including a plurality of chuck jaws and a support member, said chuck jaws being of a rigid construction and defining a frusto conical outer surface adapted to generally matably fit within said tapered bore portion of said collet and each having an inner surface with a plurality of jaw teeth thereon adapted to grip the grooves of the pin member, said support member disposed in said collet bore including elastomeric means constructed of an elastomeric material for resiliently, removably securing said chuck jaws to a forward end of said support member for resilient, radial and axial movement between open and closed positions, each of said jaws having a reduced section end portion, said elastomeric means comprising a plurality of elastic pockets integrally formed at said forward end of said support member and adapted to grippingly receive said reduced section end portion, said support member and said chuck jaws being movable within said collet bore from a first position in which said jaws are engaged with said tapered bore portion and are radially closed thereby and a second position in which said jaws are disengaged from said tapered bore portion and are in a radially open condition, said jaws as secured to said tubular sleeve normally being held in said open condition.

5. Apparatus for applying a fastener to workpieces which fastener includes a pin member having a shank and a plurality of grooves therein and a tubular fastener member adapted to be located over the shank of the pin member with the fastener being secured to the workpieces in response to a relative axial force applied to the fastener, said apparatus comprising a generally tubularly shaped anvil member having a forward portion thereof for engaging the tubular fastener member, a generally tubular collet member slidably located within said anvil member and having an axial bore terminating at its forward end in a tapered bore portion, a jaw assembly including a plurality of chuck jaws and a support member, said chuck jaws being of a rigid construction and defining a frusto conical outer surface adapted to generally matably fit within said tapered bore portion of said collet and each having an inner surface with a plurality of jaw teeth thereon adapted to grip the grooves of the pin member, said support member disposed in said collet bore, said chuck jaws being individually resiliently removably secured to a forward end of said support member, each of said jaws having a reduced section end portion, said support member having a plurality of elastic pockets integrally formed at said forward end and adapted to grippingly receive said reduced section end portion, said support member and said chuck jaws being movable within said collet bore from a first position in which said jaws are engaged with said tapered bore portion and are radially closed thereby and a second position in which said jaws are in a radially open condition, said jaws as secured in said elastic pockets of said support member normally being held in said open condition.

6. Apparatus for setting a fastener comprising a pin member having a shank and a plurality of grooves therein and a tubular fastener member adapted to be located over the shank of the pin member and cooperating with the pin member to secure a plurality of workpieces together upon the application of a relative axial force between the pin member and the tubular fastener member, said apparatus comprising a generally tubularly shaped anvil member having an aperture extending through a forward portion thereof for applying the relative axial force between the tubular member and the pin member, a generally tubular collet member slidably located within said anvil member and having an axial bore terminating at its forward end in a tapered bore portion, a plurality of chuck jaws being of a rigid construction and defining a frusto conical outer surface adapted to generally matably fit within said tapered bore portion of said collet and each having an inner surface with a plurality of jaw teeth thereon adapted to grip the grooves of the pin member, a tubular support member disposed in said collet bore, said chuck jaws being resiliently secured to a forward end of said tubular sleeve, each of said jaws having a reduced section end portion, said tubular support member having a plurality of elastic pockets at said forward end adapted to grippingly receive said reduced section end portion, said tubular support member and said chuck jaws being movable axially within said collet bore from a first position in which said jaws are engaged with said tapered bore portion and are radially closed thereby and a second position in which said jaws are in a radially open condition.

7. The apparatus of claim 6 with said jaws being selectively movable into and out of said elastic pockets whereby manual insertion and replacement of said jaws is facilitated.

8. The apparatus of claim 6 said elastic pockets having a generally smooth internal surface and with said jaw end portions being of a ribbed structure defining an interference fit with said pocket internal surface for facilitating resilient gripping by said elastic pockets.

9. The apparatus of claim 6 with said elastic pockets having a depth at least equal to the length of said jaw end portions, each of said jaws having a seating surface from which said end portion extends, said seating surface adapted to engage said forward end of said tubular support member to locate said jaws in axial alignment with each other whereby said jaw teeth on said jaws are maintained in line with each other.

10. The apparatus of claim 9 with said elastic pockets being separated from each other by axially extending slots, said elastic pockets being defined by relatively thin sections whereby misalignment of said jaw teeth can be accommodated by axial shifting of said chuck jaws.

11. In a tool for setting a fastener which includes a pin member having a shank with a plurality of grooves, the invention comprising a plurality of chuck jaws each having an inner surface with a plurality of jaw teeth thereon adapted to grip at least some of the grooves of the pin member, said chuck jaws being of a rigid construction and being resiliently secured to a forward end of a support member, each of said jaws having a reduced section end portion, said support member having a plurality of elastic pockets integrally formed at said forward end and adapted to grippingly receive said reduced section end portion, said elastic pockets having a depth at least equal to the length of said end portions, each of said jaws having a seating surface from which said end portion extends, said seating surface of each of said jaws adapted to engage said forward end of said support member to locate said jaws in axial alignment with each other whereby said jaw teeth on said jaws are maintained in line with each other.

12. The apparatus of claim 11 with said jaws being selectively movable into and out of said elastic pockets whereby manual insertion and replacement is facilitated.

13. The apparatus of claim 11 with said elastic pockets having a generally smooth internal surface and with said end portion being of a ribbed structure defining an interference fit with said pocket internal surface for facilitating resilient gripping by said elastic pockets.

14. The apparatus of claim 11 with said elastic pockets being separated from each other by circumferentially spaced axially extending slots, said elastic pockets being defined by relatively thin sections whereby misalignment of said jaw teeth can be accommodated by axial shifting of said chuck jaws.

* * * * *